US005265967A

United States Patent [19]

Han

[11] Patent Number: 5,265,967

[45] Date of Patent: Nov. 30, 1993

[54] SWIVEL LOCK ASSEMBLY FOR USE IN RINGBINDERS AND THE LIKE

[75] Inventor: Young S. Han, Douglastown, N.Y.

[73] Assignee: U.S. Ringbinder Corp., New Bedford, Mass.

[21] Appl. No.: 998,812

[22] Filed: Dec. 30, 1992

[51] Int. Cl.[5] ..... B42F 3/04

[52] U.S. Cl. ..... 402/44

[58] Field of Search ..... 402/42, 43, 44, 45, 402/75, 80 R

[56] References Cited

U.S. PATENT DOCUMENTS

| | | | |
|---|---|---|---|
| 3,748,051 | 7/1973 | Frank | 402/44 X |
| 3,958,886 | 5/1976 | Price | 402/44 X |
| 4,011,018 | 3/1977 | Doolittle | 402/44 |
| 4,127,340 | 11/1978 | Almgren | 402/44 |

*Primary Examiner*—Timothy V. Eley
*Assistant Examiner*—Willmon Fridie, Jr.
*Attorney, Agent, or Firm*—Polster, Lieder, Woodruff & Lucchesi

[57] ABSTRACT

An improved assembly (12) for use in a ringbinder (10) to hold sheets (P) paper having holes (H) punched in them. A prong bar assembly (16) includes first and second spaced apart and aligned U-shaped members (18*a*, 18*b*) attached to respective end pieces (L1, L2) forming outer leaves of the binder. These members have respective upper and lower flanges (40*u*, 40*l*) to strengthen the members and make the ringbinder sturdier. First and second swivel locks (26*a*, 28*a*) are located at each end of the prong bar assembly. Each lock includes a pair of L-shaped links (26*b*, 26*c*, 28*b*, 28*c*) having one end pivotally attached to one of the U=-shaped members, with the other ends (46) being pivotally connected together. The swivel locks are movable from a prong bar assembly locking position to an unlocking position, this enabling the U-shaped members to move relative to each other. A pair of curved sheet holding prongs (22*a*, 22*b*) each have one end (34) stakingly attached to the respective U-shaped members. The prongs extend across prong bar assembly and form a closure for paper retained in the binder. A locking bar (20) includes a U-shaped member (70) attachable to one of the U-shaped members. The locking bar is engagable with this member to allow the binder or folder to be opened and closed.

21 Claims, 3 Drawing Sheets

SWIVEL LOCK ASSEMBLY FOR USE IN RINGBINDERS AND THE LIKE

BACKGROUND OF THE INVENTION

This invention relates to binders such as ringbinders and the like to used to hold sheets of paper or other material having holes punches in them and, more particularly, to an improved swivel lock assembly for use in such binders.

Certain ringbinders, folders, and similar paper holding or filing units are made with a swivel lock assembly. The assembly includes a locking member having one or more prongs which fit through holes punched along one side of the paper. In these binders, a heavy stock which comprises an outer leaf of the binder is attached to one side of the locking member. A second outer leaf attaches to a slide or locking bar. The slide, in turn, attaches to the other side of the locking member. To open the binder to insert or extract punched material, the slide is first released from the locking member. Next, the respective sides of the locking member are rotated away from each other, this action moving the outer end of the prong, or prongs, away from the side of the member. By releasing the outer end of the prong in this way, the punched material can be removed from the binder, or new material inserted.

Because of the usage to which binders are subjected, the locking member and slide first need to be of a rugged construction. They must also quickly and easily interlock and release from each other to make the insertion or removal of material a simple task. Part of this operation means limiting the degree of movement of the locking member. On the one hand, if the one side of the member cannot move far enough with respect to the other, paper cannot be inserted or removed. On the other hand, if the sides are pulled too far apart, the locking member will not work properly and could be damaged. Present locking member/slide design and construction does not always meet the requirements set forth above, and various improvements would help the performance of the units.

SUMMARY OF THE INVENTION

Among the several objects of the present invention may be noted the provision of an improved ringbinder construction especially a locking member/slide assembly of the ringbinder; the provision of such an improvement to provide a more rugged construction of the assembly so the ringbinder can withstand rough usage and still work properly; the provision of such an improvement in which the elements comprising the assembly readily fit together and can be separated to facilitate the installation or removal of material from the ringbinder; the provision of such an improvement in which prongs used to capture material in the ringbinder are better attached to the assembly and therefore less prone to failure; the provision of such an improvement which is readily implemented during manufacture of the assembly; the provision of such an improvement which does not effect the way a user inserts or removes material so the user is not confused as to the operation of the binder and, the provision of such an improvement which is low cost and does not otherwise effect the assembly of completed ringbinders so as not to increase its cost.

In accordance with the invention, generally stated, a swivel lock assembly is for use in a ringbinder or a folder to hold paper or similar material having a hole punched in it. This allows the assembly to capture the paper or material and retain it in the binder. A prong bar assembly includes a first U-shaped member attached to an end piece forming one outer leaf of the binder. A second U-shaped member is spaced apart from the first member and extends parallel thereto These members are turned so the respective flanges forming the legs of the U-shape face each other. The flanges add strength to the members and make the ringbinder or folder sturdier. First and second swivel locks are located at each end of the prong bar assembly. Each swivel lock includes an L-shaped link having one end pivotally attached to one of the U-shaped members. The other ends of the links are pivotally connected together. The swivel locks are movable from a prong bar assembly locking position to an unlocking position, this enabling the U-shaped members to be movable relative to each other. A curved prong has one end stakingly attached to one of the U-shaped members. This prong extends between the U-shaped members, with the unattached end of the prong abutting the other U-shaped member. This forms a closure for the paper or material being retained in the binder or folder. The other end of the prong moves away from the other U-shaped member when the prong bar assembly is moved to its open position. A locking bar includes a U-shaped member attached to an end piece forming the other outer leaf of the binder. The locking bar is engagable with the second U-shaped member of the prong bar assembly to allow the binder or folder to be opened and closed. Other objects and features will be in part apparent and in part pointed out hereinafter.

BRIEF DESCRIPTION OF THE DRAWINGS

Corresponding reference characters indicate corresponding parts throughout the drawings.

DESCRIPTION OF A PREFERRED EMBODIMENT

Figure 1:
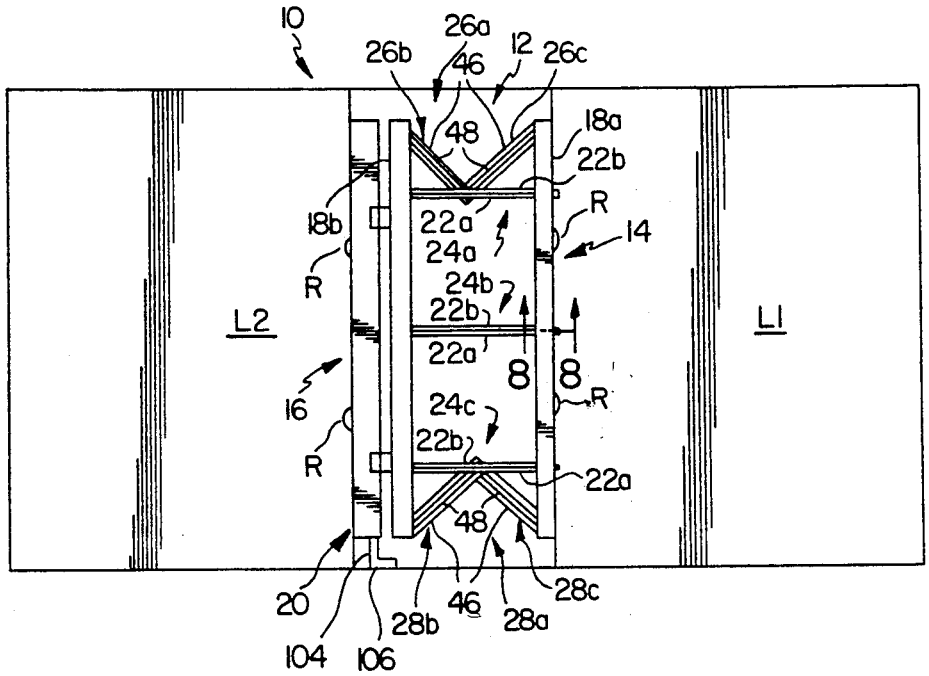
FIG. 1 is a plan view of the assembly of the present invention incorporated in a binder, the prong bar assembly of the assembly being engaged with the slide member thereof.

Referring to the drawings, a ringbinder or folder for holding punched sheets P of paper and the like (See FIG. 2) is indicated generally 10 in FIG. 1. The ringbinder stores the paper or material until it is retrieved by the person needing it. A swivel lock assembly of the present invention is designated 12. Assembly 12 releasably holds the paper so it can be readily accessed and removed when needed. It is a feature of the assembly to incorporate a number of improvements which enhance its operability and make it more rugged so it can withstand hard use.

As shown in FIG. 1, assembly 12 includes a prong bar assembly indicated generally 14 and a locking bar assembly indicated generally 16. Prong bar assembly 14 includes first and second members 18*a*, 18*b* respectively which extend lengthwise of binder 10. These members are spaced apart from and aligned parallel to each other. An outer leaf L1 of the binder is made of a sturdy material such as a cardboard. The leaf is covered with a cloth backing, for example, to form one outer cover of the binder. This leaf is attached to member 18*a* by riveting the leaf to the member at a number of places along the respective length of the member and cover as indicated at R. Similarly, a second outer leaf L2 is attached to a locking bar 20 of locking bar assembly 16, also by rivets R. As is described in more detail hereinafter, the locking bar assembly is engaged with the prong bar assembly when the binder is closed for storage. This is the condition shown in FIG. 1. When the sheets of paper are to be inserted or removed from the binder, the locking bar assembly is disengaged from the prong bar assembly as shown in FIG. 2.

Figure 2:
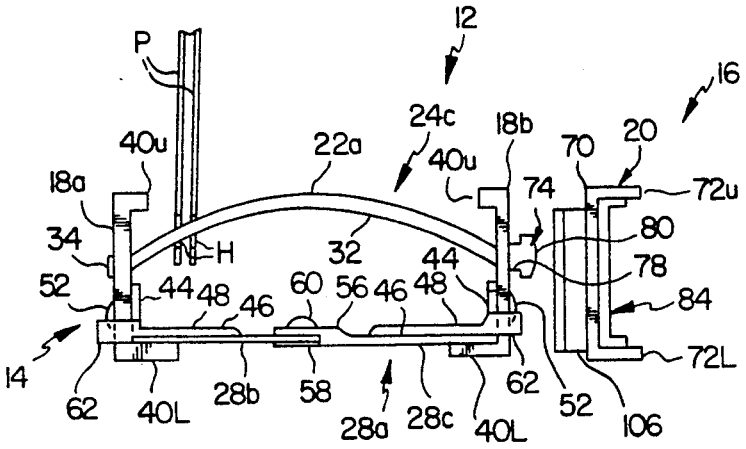
FIG. 2 is an end view of the assembly with the prong bar disengaged from the locking slide which is the initial step in opening the binder to insert or remove material.
Figure 3:
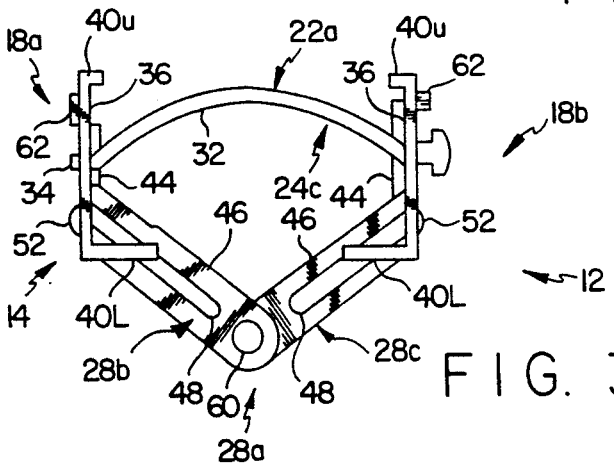
FIG. 3 is an end view of the prong bar with the swivel lock rotated to its position which enables the prong bar to be opened as a second step in inserting or removing material.
Figure 4:
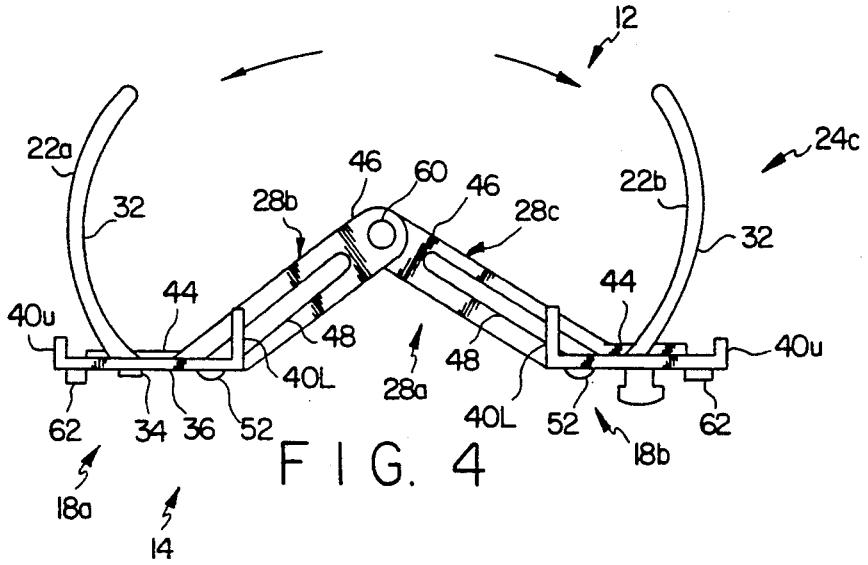
FIG. 4 is an end view of the prong bar in its opened position allowing material to be inserted or removed.

As shown in FIG. 2, the sheets P have holes H punches in them. This allows the sheets to be inserted on curved prongs 22. It will be understood that each sheet P has a plurality of holes, three, for example, punched in the margin along one side of the sheet. Prong bar assembly 14 has three sets 24*a*–24*c* of prong bars 22*a*, 22*b* spaced along the length of the assembly as shown in FIG. 1. The assembly could include more, or fewer, prong bar sets. Regardless, after disengagement of the locking bar assembly from the prong bar assembly, the prong bar assembly is still closed. The prong bar assembly has swivel locks 26*a*, 28*a* positioned at each end of the assembly. Each swivel lock includes rotatable links 26*b*, 26*c*, and 28*b*, 28*c* respectively. These links are rotatable from their position shown in FIG. 2 to the position shown in FIG. 3. This pivotal movement of the locks releases the prong bar assembly so the members can be contra-rotated as shown in FIG. 4 for the ringbinder to be opened. If the swivel locks 26*a*, 28*a* are rotated too far, so that they move past their position shown in FIG. 3, they effectively block subsequent movement of members 18*a*, 18*b* and the ringbinder cannot be opened. Accordingly, it is a feature of the invention to prevent this from occurring.

After sheets P of paper, or other punched material has been replaced in or removed from the ringbinder, the ringbinder is returned to its closed, locked condition by reversing the above described process.

Figure 8:
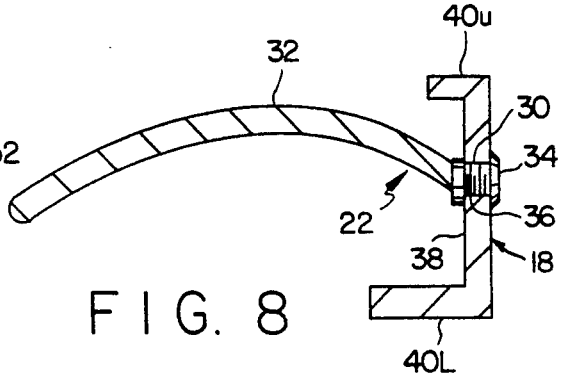
FIG. 8 is a partial sectional view of a prong taken along line 8—8 of FIG. 1.
Figure 9:
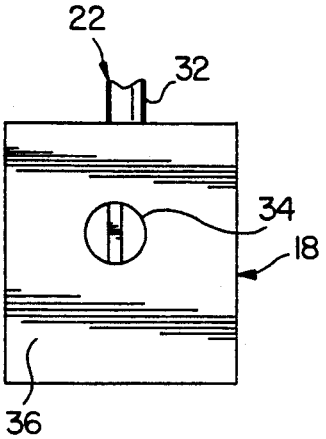
FIG. 9 is a side elevational view of the staking attachment of the prong to the prong bar assembly.
Figure 12:
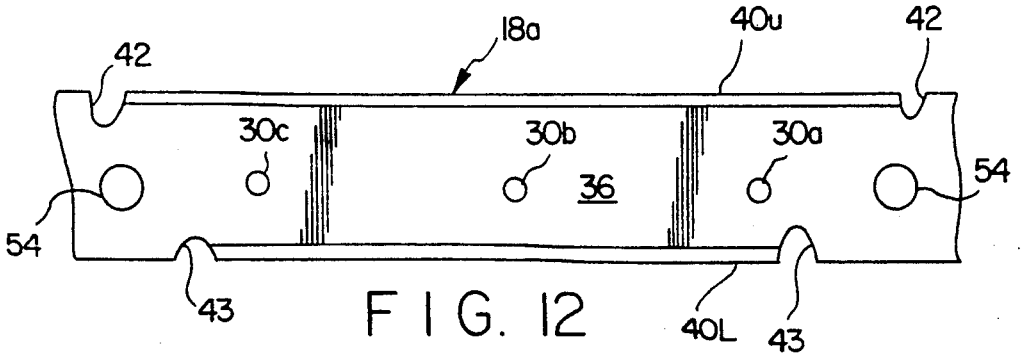
FIG. 12 is a side elevational view of a prong bar assembly member.
Figure 13:
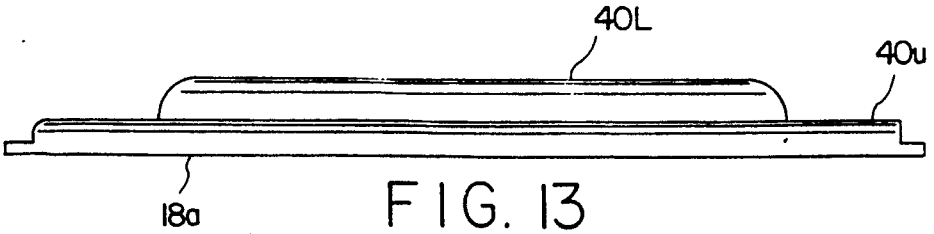
FIG. 13 is a plan view of the member.

Describing the various components of assembly 12 in more detail, referring to FIGS. 12 and 13, prong assembly member 18*a* is formed from an elongate generally rectangular plate. The plate has a three spaced openings 30*a*–30*c* for attaching prong bar 22*a* of sets 24*a*–24*c* to the member. As shown in FIGS. 8 and 9, each prong bar 22 has a curved section 32 the length of which corresponds to the spacing between the prong assembly members 18. As a result, the distal end of each prong abuts the side wall of the opposite member 18. One end of the prong bar terminates in a stud 34 having a round shank 36 sized to fit through an opening 30 in the web portion 38 of member 18. The stud is inserted through the opening from the inside to the outside of the member. After insertion, the prong bar is attached to the member by staking the end of the stud projecting through the outside of the member as shown in FIG. 9. In prior art assemblies, attachment of a prong bar to a prong bar assembly member was accomplished by a spinning operation. It has been found, however, that this allows the prong bar to wobble or otherwise move freely about. This flexibility is not desirable in a ringbinder assembly. By staking the prong bar to the member, a more rigid or tight fit is achieved.

Referring again to FIGS. 12 and 13, it is seen that each member has an upper and a lower inwardly extending flange 40*u* and 40*l* respectively. This flanges extend lengthwise of the member. As best shown in FIG. 12, upper flange 40*u* extends between notches 42 that are located at the respective ends of the member. These notches extend downwardly into web 36 of the member and serve to limit movement of the swivel locks as described hereinafter. Lower flange 401 is shorter than the upper flange and extends only between respective notches 43 formed in the base of the member. As shown in FIG. 13, the lower flange extends outwardly from the side of the member farther than the upper flange. Members 18*a*, 18*b*, as seen in FIGS. 2–4, have a generally U-shape when viewed on end or in cross-section because of these upper and lower flanges. The flanges are important because they add strength to the members. Typically, prior prong bar assembly members had a flange along their lower reach giving them a generally L-shape when viewed in section. However, it has been found that adding a flange along the other reach makes the member stronger and more able to withstand the use to which the ringbinder is subjected.

Figure 10:
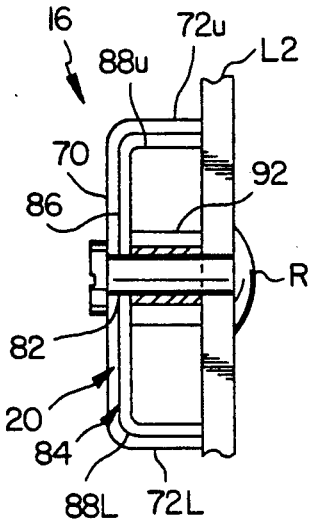
FIG. 10 is a partial side elevational view of the member of the prong bar assembly showing one link of a swivel lock in its assembly locking position.
Figure 11:
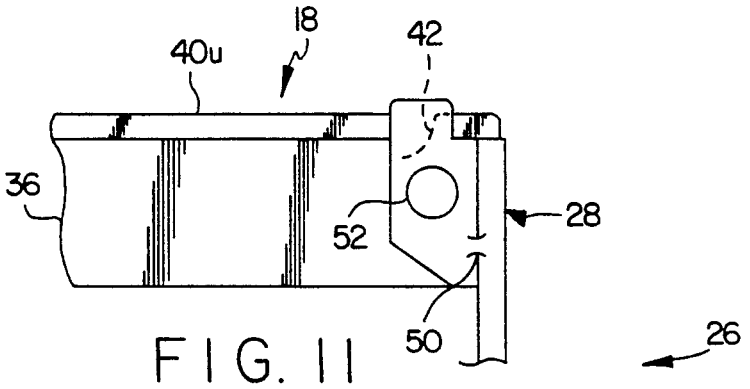
FIG. 11 is a partial side elevational view of the member similar to FIG. 10 and showing the link moved to a position allowing the prong bar assembly to open, the link being limited in movement to prevent over-rotation of the swivel lock.

Referring to FIGS. 10 and 11, each link of swivel locks 26*a*, 28*a* is L-shaped with an upturned segment 44 which connects to web 36 of a member 18, and an arm segment 46 which extends diagonally across the space separating the members. A reinforcing rib 48 is formed on each arm and extends from the end of the arm adjacent segment 44 substantially the length of the arm. As shown in FIGS. 3 and 4, these ribs taper from their inner end. In addition, at the juncture where the arm and upturned segment meet, an embossment 50 is formed. This, together with the rib 48 serve to strengthen the link.

The upturned segment of each link is pivotally connected to a member 18 by a pin 52 which is inserted through an opening 54 (see FIG. 12) formed at the respective ends of the member. This attachment allows the swivel lock links to rotate from their FIG. 2 to FIG. 3 positions as previously described. As shown in FIG. 10, the outer end of one of the link arms 46 is offset or slightly raised as indicated at 56. The outer end of the arm of its companion link is also offset, but slightly lowered as indicated at 58 in FIG. 2. Accordingly, this allows the outer ends of the two links to overlap each other. A pin 60 is inserted through the outer end of the overlapping links to connect them together This allows the links to rotate relative to each other from their position shown in FIG. 3 to their position shown in FIG. 4 as the prong bar assembly is moved to the binder open position. Each upturned segment 44 has a latch arm 62 which extends rearwardly of the segment. The latch arm is also bent so that is extends behind the member 18 to which the link is attached. This portion of the arm is spaced sufficiently far from the end of the member so as to not interfere with movement of the link as the swivel lock is rotated from its FIG. 2 to its FIG. 3 position.

As the swivel reaches its FIG. 3 position, latch arm 62 slides into the notch 42 formed in the member. The latch is captured in the notch which prevents further rotational movement of the link in that direction; although, it does not interfere with rotation of the swivel lock from its FIG. 3 to its FIG. 4 position. The notch-/latch combination prevents the swivel lock from being overrotated. Overrotation of the lock, as noted above, would prevent the lock from being subsequently rotated to open the ringbinder. In prior prong bar assemblies, over rotation was prevented by forming an indentation in the side of member 18 adjacent the section of the link connecting with the member. This section then has a flattened surface which bore against the indentation when the swivel lock reached a position comparable to that of FIG. 3 to stop further movement of the link. Over time, the indentation would be worn down until it would no longer impede rotation of the link. Overrotation could then result.

Figure 5:
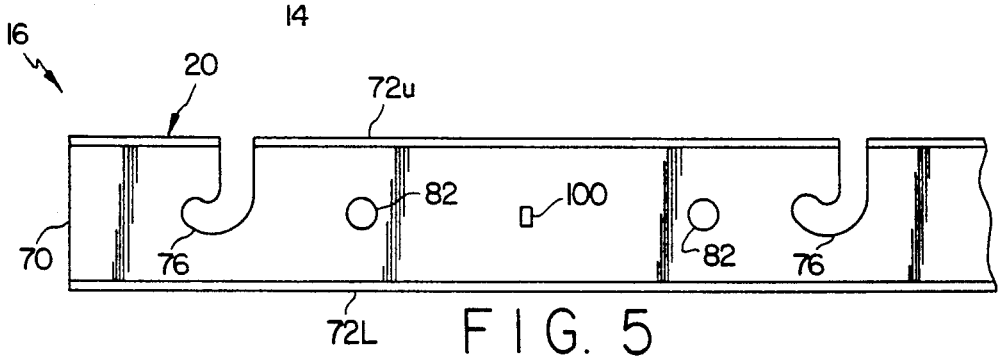
FIG. 5 is a side elevational view of a locking bar which attaches to the prong bar assembly.

Locking bar assembly 16, as noted, includes locking bar 20. As shown in FIG. 5, bar 20 includes an elongate rectangular plate 70. Respective upper and lower flanges 72*u* and 72*l* are formed on one side of the plate so the locking bar is a U-shaped bar when viewed in section. Prong bar assembly member 18*b* includes respective studs 74 (see FIG. 2) located at each end of the member for engaging the locking bar assembly and the prong bar assembly. Engagement of member 18*b* with locking bar 20 is achieved by inserting the studs 74 into J-slots 76 formed at the respective ends of bar 20. Slots 76 extend downwardly from the top of the locking bar. The curved lower portion of each slot curves in the same direction. As shown in FIG. 2, the studs 74 which are attached to member 18*b* by a staking or spinning operation, extend outwardly from the outer face of the member. Each stud has a shank 78 and a head 80. The width of the shank corresponds to the thickness of locking bar 20 so the stud readily fits into slot 76. The diameter of head 80 of each stud is larger than the width of the slot. Now the locking bar assembly cannot be dislodged by a sideways pulling movement on the leaf L to which the locking bar is attached. The locking bar includes rivet holes 82 for the previously described attachment of the bar to leaf L2.

Locking bar assembly next includes a spring bar 84 which is used in conjunction with the locking bar to capture the studs in the J-slots and hold them in place so the prong bar assembly remains engaged with the locking bar assembly. Spring bar 84 also comprises a elongate rectangular plate 86 having upper and lower flanges 88*u*, 88*l* respectively. The bar also has elongate openings 90 for accommodating the rivets R used for attaching the locking bar assembly to the leaf L2.

Figure 7:
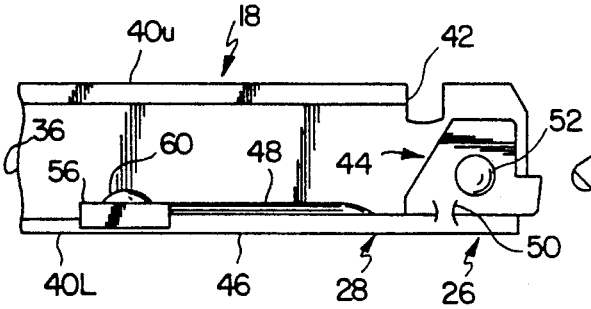
FIG. 7 is an end view of the locking bar and spring bar with a spacer used to properly position them.

As shown in FIG. 7, locking bar 20 and spring bar 84 are each U-shaped when viewed in section. Further, the spring bar is sized to nest within the locking bar. A spacer 92 is of a hollow, cylindrical shape and fits over the shank of the rivets R used to attach end leaf L2 to the locking bar assembly. This spacer keeps the locking bar assembly spacing uniform throughout the length of the binder so no distortion or twisting occurs between the end leaf and the assembly which might otherwise cause the assembly to not function properly.

Figure 6:
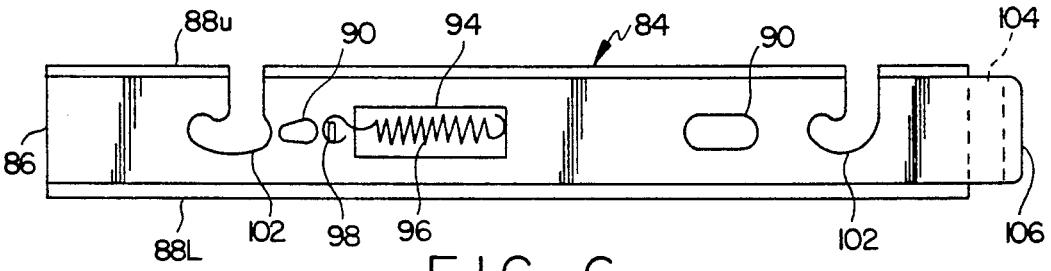
FIG. 6 is a side elevational view of a spring bar for engaging the locking bar and prong bar assembly.

The purpose of spring bar 84 is to releasably capture the studs 74 inserted in slots 76. For this purpose, bar 84 has a generally centrally located, rectangular slot 94. A helical spring 96 has one end captured in a raised nib 98 formed on the outer face of plate 86. The other end of the spring is captured on a raised nib 100 formed on the outer face of plate 70. The location of nib 100 is such that it fits within the open area defined by slot 94. As seen in FIG. 6, a pair of J-slots 102 are formed in plate 86. These slots are located at the respective ends of the spring bar and also extend downwardly into the plate from the top edge thereof. The slots 102 are offset with respect to the slots 76. Therefore, when the studs 74 are to be inserted into the slots, bar 86 is moved relative to bar 70, against the force of spring 96, until the respective slots 76, 102 overlap each other. Once the studs are positioned in the lower curved portion of the slots, plate 86 is returned toward its original position. The lower curved portion of the slots 102 are slightly larger than the corresponding portion of the slots 76. Accordingly, the lower end of these slots bear against the shank of the studs while the upper, vertical portion of the slots are shifted out of registry with the vertical section of the slots 76. The studs cannot now be displaced, and the locking bar assembly will remain engaged with the prong bar assembly.

Plate 86 of the spring bar has an extension 104 which is inwardly turned at its outer end to provide a tongue 106 by which a user can move the spring bar relative to the locking bar. The user moves the spring bar placing his thumb against the outer face of the inwardly turned section of the tongue and pushing. This moves the spring bar against the force of spring 96. When the thumb is withdrawn, the spring bar is returned to its initial position by the force of the spring.

What has been described is an improved ringbinder construction and in particular an improved locking member/slide assembly of the ringbinder. The various improvements above described provide for a more rugged construction of the assembly. This permits the ringbinder to withstand rough usage while still working properly. Further, the prong bar and locking bar portions of the assembly more readily fit together and are more readily separated; this facilitating insertion and removal of material from ringbinder. As an example of the improvements described, the prongs used to capture material in the ringbinder are attached to the assembly in a different way which makes them less prone to failure. Other changes includes changes in construction of the locking bar assembly and in the manner of attachment of the prong bar and locking bar assemblies. At the same time, the changes do not significantly effect the way someone inserts or removes material from the binder. Thus they would not be confused as to the operation of a binder with the new assembly as compared with binders employing prior assemblies.

In view of the foregoing, it will be seen that the several objects of the invention are achieved and other advantageous results are obtained.

As various changes could be make in the above constructions without departing from the scope of the invention, it is intended that all matter contained in the above description or shown in the accompanying drawings shall be interpreted as illustrative and not in a limiting sense.

Having thus described the invention, what is claimed and desired to be secured by Letters Patent is:

1. A swivel lock assembly for use in a ringbinder or a folder to hold paper or similar material having a hole punched in it for the assembly to capture the paper or material and retain it in the binder comprising:

a prong bar assembly including a first U-shaped member attached to an end piece forming one outer leaf of the binder, a second U-shaped member spaced apart from the first said member and extending parallel thereto, the first and second members being turned so the respective flanges forming the legs of the U-shape face each other, said flanges adding strength to the members to make the ringbinder or folder sturdier;

first and second swivel locks located at each end of the prong bar assembly, each swivel lock including a pair of L-shaped links having one end pivotally attached to one of the U-shaped members with the other ends of the links being pivotally connected together, the swivel locks being movable from a prong bar locking position to an unlocking position thereby enabling the U-shaped members to be movable relative to each other;

at least one curved prong having one end stakingly attached to one of the U-shaped members and extending between the U-shaped members with the other end of the prong abutting the other U-shaped member to form a closure for the paper or material being retained in the binder or folder, the other end of the prong moving away from said other U-shaped member when the prong bar assembly is moved to its open position; and, a locking bar including a U-shaped bar attached to an end piece forming the other outer leaf of the binder, and means for engaging said locking bar with said second U-shaped member thereby to allow the binder or folder to be opened and closed.

2. The assembly of claim 1 wherein the engaging means includes at least one stud attached to one wall of said locking bar with the head of said stud pointing toward said second U-shaped member of said prong bar assembly.

3. The assembly of claim 2 wherein said second U-shaped member of said prong bar assembly has a slot extending from one edge thereof inwardly into the web portion of the member, said slot being sized to receive a shank portion of the stud.

4. The assembly of claim 3 wherein said slot is a J-shaped slot.

5. The assembly of claim 4 further including a stud located at each end of the locking bar, said second U-shaped member having a J-shaped slot at each end thereof for receiving the respective studs.

6. The assembly of claim 5 wherein the engaging means further includes spring means for capturing the respective studs in the respective J-slots after their insertion therein.

7. The assembly of claim 6 wherein the spring means includes a U-shaped bar sized to fit within the locking bar and a spring, one end of said spring being attached to said locking bar and the other end thereof being attached to said U-shaped bar, said U-shaped bar having a respective slots at each end in which the heads of the respective studs are captured, said spring urging said U-shaped bar in a direction by which one end of said respective slots bear against the studs to maintain the studs in place.

8. The assembly of claim 7 further including spacer means for spacing the U-shaped bar from the locking bar.

9. The assembly of claim 1 further including means for preventing over-rotation of the swivel locks when they are rotated to the position allowing the prong bar to be opened, over-rotation of the swivel locks otherwise preventing opening movement of the prong bar.

10. The assembly of claim 9 wherein the end of each L-shaped member attached to one of the U-shaped members has a latch formed thereon and the U-shaped member has a notch into which the latch fits as the swivel lock rotates to the prong bar assembly opening position, the notch capturing the latch and preventing further movement of the swivel lock which would produce an over-rotation of the swivel lock.

11. The assembly of claim 10 further including means located at the angle between the legs on each L-shaped member for reinforcing the L-shaped member to make it sturdier.

12. The assembly of claim 1 further including a second curved prong having one end stakingly attached to the other of said U-shaped members and also extending between the U-shaped members with the other end of the prong abutting the one U-shaped member, the other end of said second prong moving away from said one U-shaped member when the prong bar assembly is moved to its open position.

13. The assembly of claim 12 wherein said first and second prongs are positioned adjacent each other to form a pair of holders for the paper or other material.

14. The assembly of claim 13 further including additional pairs of holders spaced along the length of the prong bar assembly, each pair of holders similarly being comprised of a first and a second prong.

15. In a ringbinder for holding punched sheets of paper and the like, and improved swivel lock assembly for releasably holding the paper comprising:

a prong bar assembly having first and second members spaced apart from and aligned parallel to each other, each member having an upper and a lower inwardly extending flange extending lengthwise of the member, said lower flange extending farther inward than the upper flange and extending farther along the length of the member than said upper flange, and said members being rotatably movable relative to each other between a binder closed and a binder opened position;

first and second curved prongs positioned adjacent each other, one of said prongs having one end stakingly attached to one of said members and the other prong having one end stakingly attached to the other of said members, both prongs extending between the members with the non-staked end of the respective prongs abutting the opposite member, the prongs moving away from each other when the binder is opened; and first and second swivel locks respectively located at opposite ends of the prong bar assembly, each swivel lock including a pair of links each of which has one end pivotally attached to one of the members with the other ends of the links being pivotally connected together, the swivel locks being movable from a prong bar assembly locking position to an unlocking position thereby enabling the U-shaped members to be movable relative to each other, each of said links having a latch formed thereon and each member having a notch at each respective end into which the latches fit as the respective swivel lock rotate to a prong bar assembly opening position, each notch capturing its associated latch to prevent further movement of the swivel locks and prevent overrotation thereof, overrotation of the swivel locks inhibiting opening of the prong bar assembly.

16. The assembly of claim 15 further including a locking bar assembly removably attachable to one of the prong bar assembly members, said locking bar assembly including a locking bar and means for engaging said locking bar with said member thereby to allow the binder to be opened and closed.

17. The assembly of claim 16 wherein the engaging means includes a pair of studs extending outwardly from a side wall of said locking bar, the heads of said studs pointing toward said prong bar assembly member, said prong bar assembly member having respective slots at each end extending from one edge of the inwardly into the web portion of the member, each slot being a J-shaped slot sized to receive a shank portion of the stud.

18. The assembly of claim 17 wherein the engaging means further includes spring means for capturing the respective studs in the respective slots and including a spring bar movable relative to the locking bar and a spring, one end of said spring being attached to said locking bar and the other end thereof being attached to said spring bar, said spring bar having slots at each end in which the heads of the respective studs are captured, said spring urging the spring bar in a direction by which one end of said respective slots bear against the studs to maintain them in place.

19. The assembly of claim 18 wherein both the locking bar and spring bar have outwardly extending flanges at their upper and lower ends to strengthen the respective bars, said spring bar being sized to fit within the space defined by the flanges of the locking bar, and the locking bar assembly further includes spacer means for spacing spring bar from the locking bar.

20. The assembly of claim 15 further including additional pairs of holders spaced along the length of the prong bar assembly, each pair of holders similarly being comprised of a first and a second prong.

21. The assembly of claim 20 further including reinforcing means located at the angle between the legs on each link for reinforcing the link to make it sturdier.

* * * * *